US007219712B2

(12) United States Patent
Qiu et al.

(10) Patent No.: US 7,219,712 B2
(45) Date of Patent: May 22, 2007

(54) REDUCED SHEDDING REGENERATOR AND METHOD

(75) Inventors: Songgang Qiu, Richland, WA (US); John E. Augenblick, Richland, WA (US); Raymond M. Erbeznik, Kennewick, WA (US)

(73) Assignee: Infinia Corporation, Kennewick, WA (US)

( * ) Notice: Subject to any disclaimer, the term of this patent is extended or adjusted under 35 U.S.C. 154(b) by 199 days.

(21) Appl. No.: 11/007,628

(22) Filed: Dec. 7, 2004

(65) Prior Publication Data

US 2006/0118273 A1 Jun. 8, 2006

(51) Int. Cl.
*F28D 17/02* (2006.01)

(52) U.S. Cl. ..... 165/10; 62/437; 29/890.034

(58) Field of Classification Search ..... 165/10; 62/6, 437; 60/517, 526, 527; 29/890.03, 29/890.034

See application file for complete search history.

(56) References Cited

U.S. PATENT DOCUMENTS

| | | | | |
|---|---|---|---|---|
| 3,062,509 | A * | 11/1962 | Mulder | 165/10 |
| 6,591,609 | B2 * | 7/2003 | Kamen et al. | 60/526 |
| 2001/0039801 | A1 * | 11/2001 | Bliesner et al. | 60/517 |
| 2003/0000226 | A1 * | 1/2003 | Amano | 62/6 |
| 2004/0003591 | A1 | 1/2004 | Kamen et al. | |
| 2004/0025502 | A1 * | 2/2004 | Okano et al. | 60/517 |
| 2004/0231340 | A1 * | 11/2004 | Bin-Nun et al. | 62/6 |

FOREIGN PATENT DOCUMENTS

DE 3934545 A1 * 5/1991

* cited by examiner

*Primary Examiner*—Teresa J. Walberg
(74) *Attorney, Agent, or Firm*—Brian L. Johnson; George C. Rondeau, Jr.; Davis Wright Tremaine LLP

(57) ABSTRACT

A reduced shedding regenerator and method are disclosed with regenerator surfaces to minimize shedding of particles from the regenerator thereby alleviating a source of potential damage and malfunction of a thermal regenerative machine using the regenerator.

29 Claims, 9 Drawing Sheets

REDUCED SHEDDING REGENERATOR AND METHOD

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of contract No. DE-AC03-02SF22491 awarded by the United States Department of Energy.

BACKGROUND OF THE INVENTION

1. Field of the Invention

The present invention is directed generally to machines and, more particularly, to thermal regenerative machines.

2. Description of the Related Art

A conventional thermal regenerative machines including Stirling cycle engines and coolers use a working fluid, such as a gas. Portions of the working fluid travel in passageways between a hot area and a cold area. As the working fluid travels from the hot area to the cold area, it passes through a conventional random fiber mesh material called a regenerator that retains heat from the working fluid. As the working fluid returns from the cold area back to the hot area, it receives some heat back from the regenerator thereby resulting in increased efficiency. Unfortunately, the mesh material of the regenerator can shed small particles, which migrate within the machine to become undesirably located in other regions and parts of the machine, thereby introducing a potential cause of damage or malfunction. Conventional approaches to reduce shedding have included addition of screen components to end surfaces where working fluid either flows into or out of the regenerator. These approaches have had limited success. Other surfaces of the regenerators remain unprotected and the additional screen components increase piece counts for manufacturing.

BRIEF SUMMARY OF THE INVENTION

Aspects according the present invention for a thermal regenerative machine having a first temperature area and a second temperature area are directed to a regenerator comprising a first layer portion having a first thickness, a first porosity, and a first material composition; and a second layer portion adjacent the first layer, the second layer having a second thickness, a second porosity, and the first material composition, the second thickness being greater than the first thickness, the second porosity being greater than the first porosity, the regenerator configured to be positioned within the thermal regenerative machine such that the first layer portion is nearer the first temperature area than the second layer portion.

Other aspects include in some implementations the first layer portion being made from a first number of sheets of random fiber material and the second layer portion being made from a second number of sheets of random fiber material, the first number being smaller than the second number. Other aspects include the first number of sheets being one. Other aspects include the random fiber material of the first layer portion being sintered a first number of times and the random fiber material of the second layer portion being sintered a second number of times, the first number being greater than the second number. Other aspects include wherein the second number is one.

Other aspects include a third layer portion adjacent the second layer portion on a side thereof away from the first layer portion, the third layer having the first material composition and a thickness less than the second layer portion, the third layer portion having a porosity less than the second layer portion, the regenerator configured to be positioned within the thermal regenerative machine such that the third layer portion is nearer the second temperature area than the first and second layer portions.

Other aspects include the first layer portions and the third layer portions being constructed from a twice sintered sheets of random fiber material and the second layer portion being constructed from a once sintered sheets of random fiber material. Other aspects include the second layer portion being configured to shed particles sized with respect to the second porosity of the second layer portion that they pass through the second layer portion toward the first layer portion, and the first porosity of the first layer portion being sufficiently small to prevent at least a majority of the shed small particles from passing through the first layer portion.

Other features and advantages of the invention will become apparent from the following detailed description, taken in conjunction with the accompanying drawings.

BRIEF DESCRIPTION OF THE SEVERAL VIEWS OF THE DRAWING(S)

DETAILED DESCRIPTION OF THE INVENTION

As will be discussed in greater detail, a reduced shedding regenerator and method are disclosed herein with regenerator surfaces to minimize shedding of particles from the regenerator thereby alleviating a source of potential damage and malfunction of a thermal regenerative machine using the regenerator.

Figure 1:
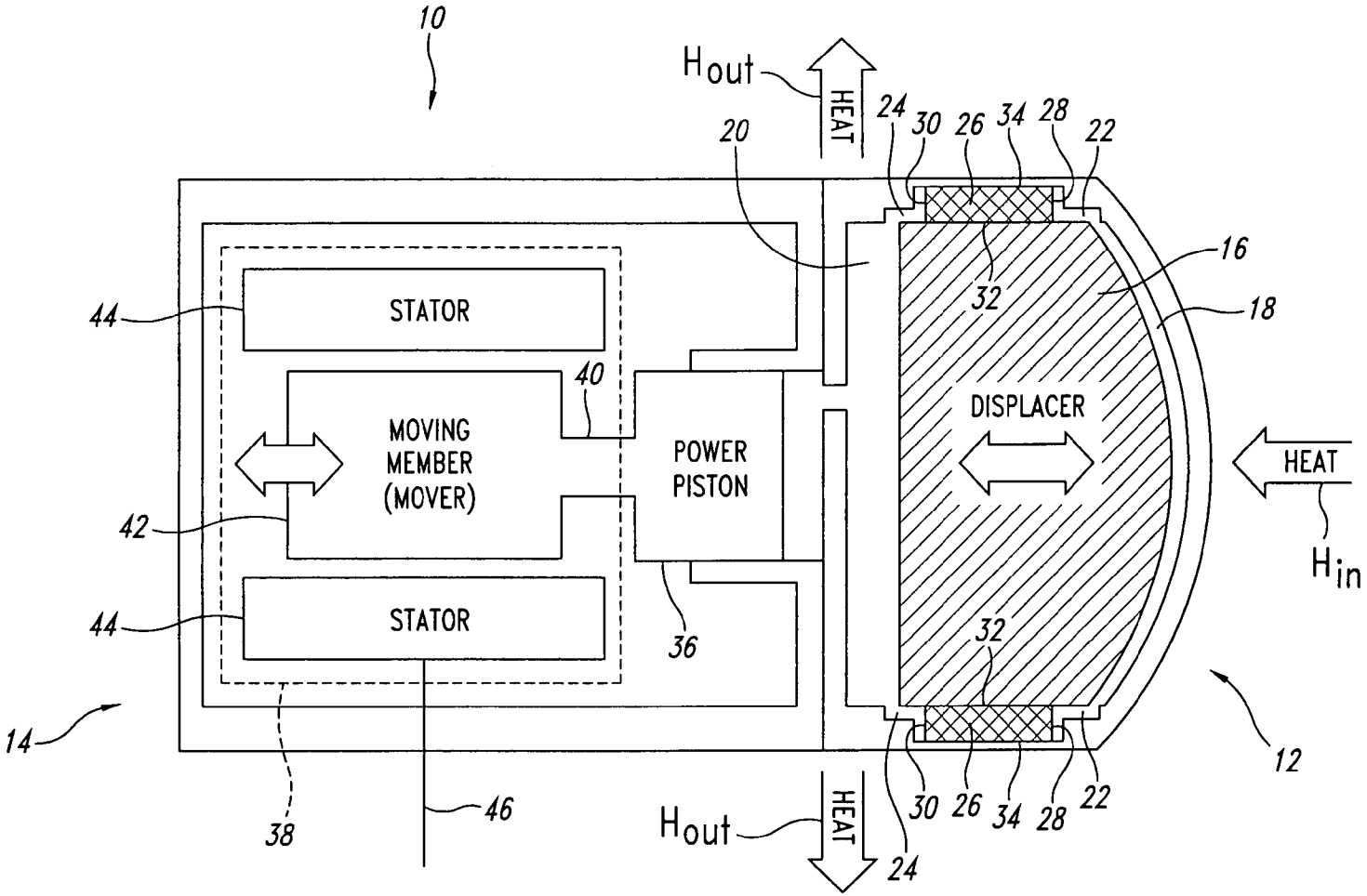
Fig. 1 (Prior Art)
FIG. 1 is a schematic of a conventional thermal regenerative machine.

A simplified view of an exemplary conventional thermal regenerative machine 10 using a Stirling cycle module 12 and a power module 14 is shown in FIG. 1. In the implementation depicted, the Stirling cycle module 12 has a displacer 16 that is moved by pressure differences, which also cause working fluid to move between a first temperature area 18 and a second temperature area 20 by passing through a first passageway 22 coupled to the first temperature area 18 and a second passageway 24 coupled to the second temperature area 20. Typically a thermal source (not shown) is positioned adjacent the first passageway 22 and a thermal sink (not shown) is positioned adjacent the second passageway 24.

An exemplary conventional regenerator 26 is annular and has a first end surface 28, a second end surface 30, an interior surface 32, and an exterior surface 34. The regenerator 26 is positioned between the first passageway 22 and the second passageway 24 such that the first end surface 28 of the regenerator is adjacent the first passageway 22 and the second end surface 30 of the regenerator is adjacent the second passageway 24. Other conventional implementations of thermal regenerative machines utilize regenerators of other shapes that may not have hollow annular cores such as having solid cylindrical or other shapes that depend upon the configuration of the particular Stirling cycle module involved.

When the first temperature area 18 is significantly higher in temperature than the second temperature area 20, the thermal source inputs heat $H_{in}$ to the working fluid in the first passageway 22 and the thermal sink takes heat $H_{out}$ from the working fluid in the second passageway 24. The regenerator 26 receives heat from the working fluid as the working fluid passes from the first passageway 22 to the second passageway 24. The regenerator 26 returns some of this received heat back to the working fluid as the working fluid passes back from the second passageway to the first passageway.

The second temperature area 20 is in fluid communication with a power piston 36, which is part of the power module 14. The power piston 36 of the power module 14 is connected to a conventional linear electrodynamic system 38 through a shaft 40 coupled to a mover 42. The conventional linear electrodynamic system 38 further includes a stator 44 and an electrical line 46 to furnish electrical power when the thermal regenerative machine 10 is used as an electrical generator and to receive electric power when the electrothermal system is used as a cooler. Other thermal regenerative machines can have other electromotive configurations besides a moving iron linear alternator or motor such as those utilizing moving magnets.

As described, the regenerator 26 serves to receive heat from the working fluid, retain the heat, and then return the retained heat back to the working fluid. Conventional random fiber mesh material has been conventionally found to be effective for these functions of the regenerator 26. Other materials have been used including wire screens and/or woven screens, porous materials, and those using short fibers, metals, plastics, powdered metals, and so forth. A typical method of conventional construction of the regenerator 26 involves sintering a compressed stack of loosely woven random fiber mesh sheets to form a porous unit of material commonly referred to as a brick. Other approaches exist such as those using pre-sintered sheets to form porous brick units. The brick is then machined to form the proper shape for the regenerator 26. In other implementations stacked screens are used or short fiber is poured into a mold to form a sintered ring. Unfortunately, the regenerator 26 conventionally formed from loose pre-sintered sheets of random fiber mesh material or the many other conventional means has a proclivity to shed small particles that can then migrate into seals, voids, and other areas of the Stirling cycle module 12 with potentially detrimental consequences.

Figure 2:
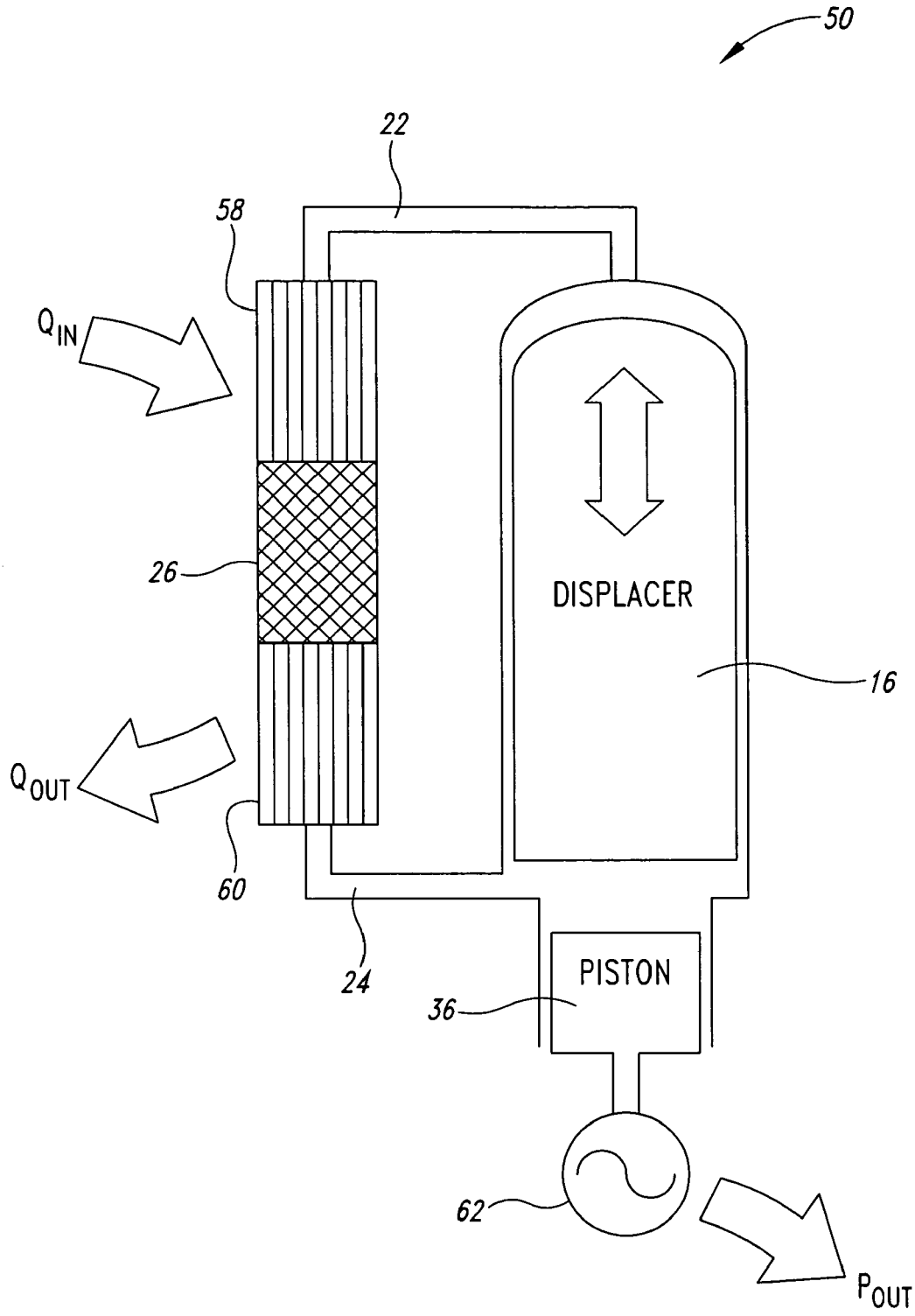
Fig. 2 (Prior Art)
FIG. 2 is a schematic of an exemplary engine implementation of a thermal regenerative machine.
Figure 3:
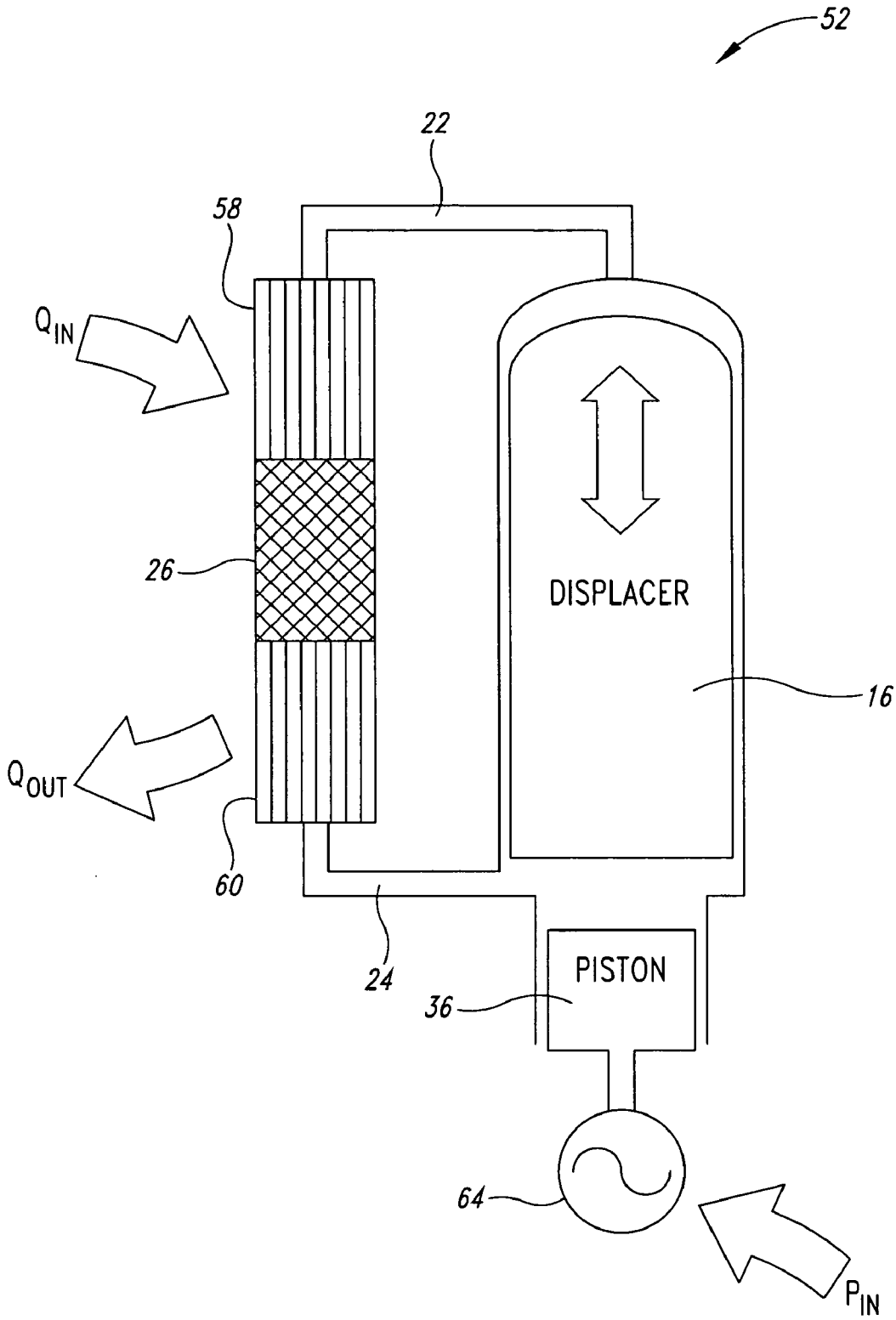
Fig. 3 (Prior Art)
FIG. 3 is a schematic of an exemplary cooler implementation of a thermal regenerative machine.
Figure 4:
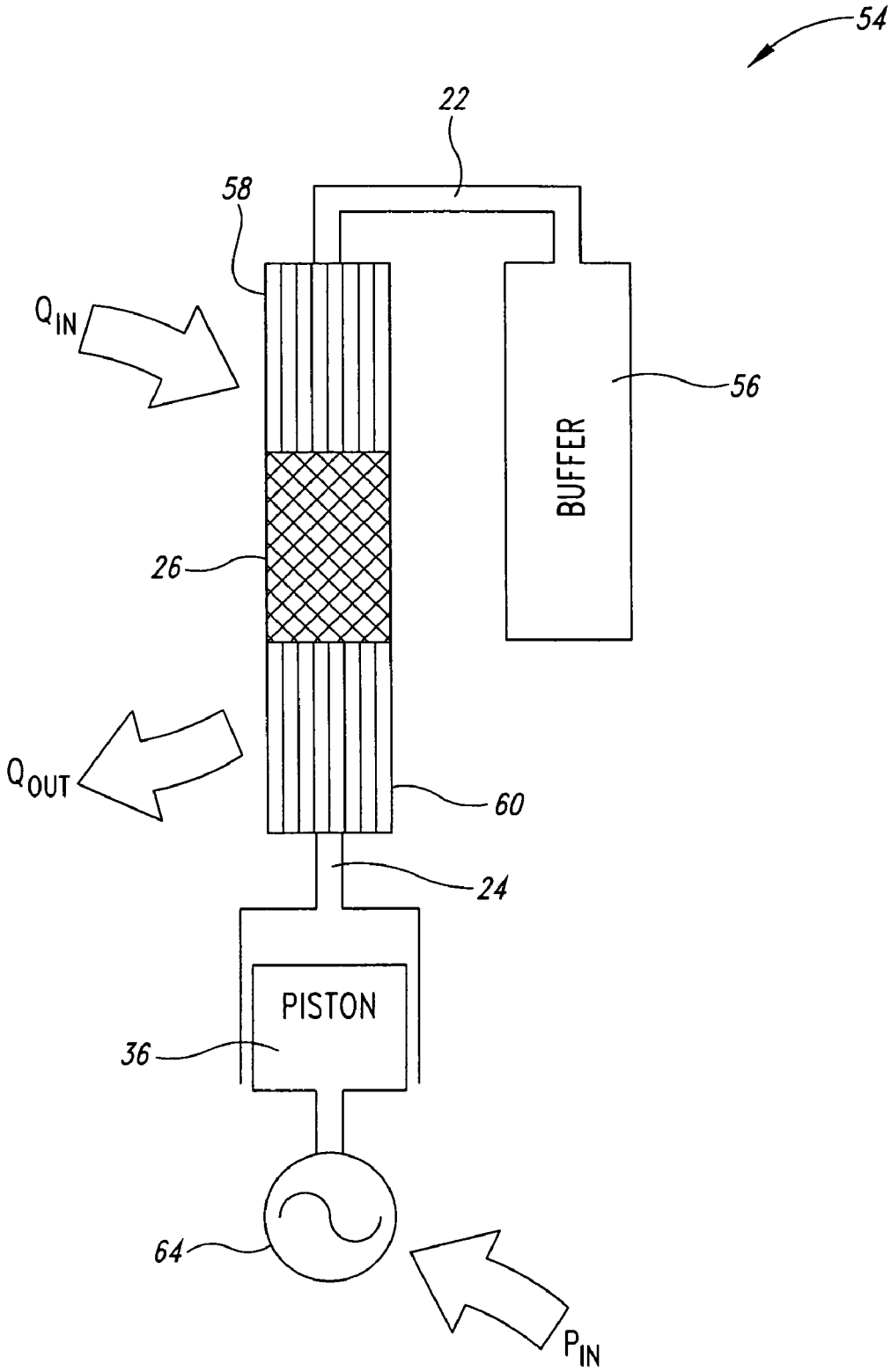
Fig. 4 (Prior Art)
FIG. 4 is a schematic of an exemplary pulse tube cooler implementation of a thermal regenerative machine.

As shown in FIGS. 2–4, the regenerator 26 is used in many different applications such as with the regenerative thermal machine 10 being used as an engine 50 to produce electrical power (FIG. 2), as a cooler 52 (FIG. 3) and as a special form of cooler called a pulse tube cooler 54 (FIG. 4) in which the displacer 16 is not present but a buffer chamber 56 is used according to conventional practice. As depicted, the regenerator 26 is typically positioned, in terms of working fluid flow, between a heat acceptor heat exchanger 58 that receives heat from a heat source and a heat rejecter heat exchanger 60 that outputs heat to a heat sink. The power module 14 of the engine 50 is typically an alternator 62. The power module 14 of the cooler 52 and pulse tube cooler 54 is typically a motor 64.

Figure 5:
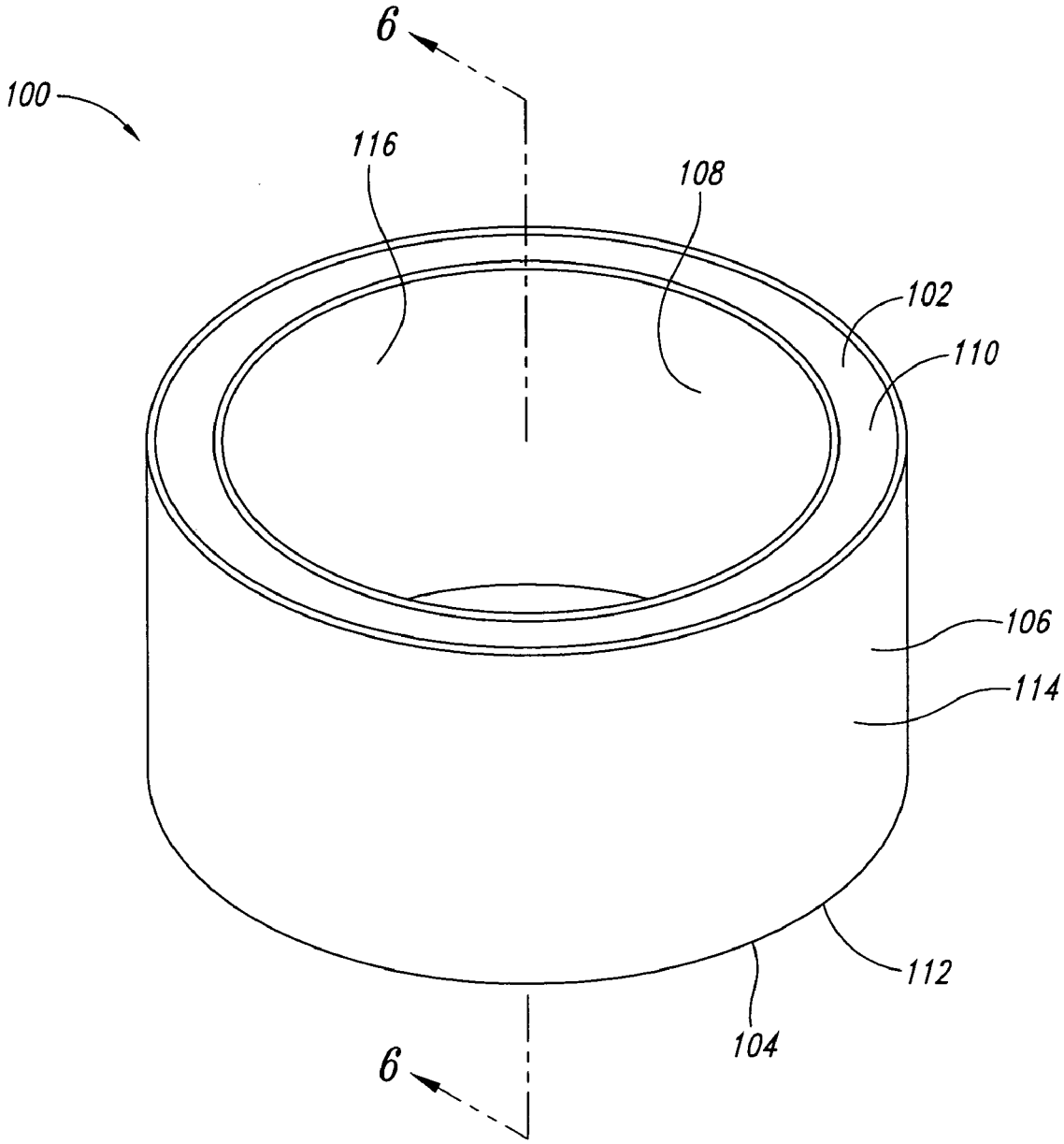
FIG. 5 is an isometric diagram of a reduced shedding regenerator

To reduce this shedding problem, one implementation of a reduced shedding regenerator, shown in FIG. 5 as an annular reduced shedding regenerator 100, is formed as having a first end surface 102, a second end surface 104, an exterior surface 106, and an interior surface 108. The regenerator 100 may be used in place of the conventional regenerator 26 shown in FIG. 1. Generally, the regenerator 100 is constructed so that a first end layer 110, better shown in FIG. 6, includes the first end surface 102 and extends longitudinally a relatively small amount toward the second end surface 104. A second end layer 112 includes the second end surface 104 and extends longitudinally a relatively small amount toward the first end surface 102.

The first layer 110 and the second layer 112 of the regenerator have a porosity less than the conventional regenerator 26 to substantially reduce the number of particles that escape from within the regenerator 100 out the first end surface 102 and the second end surface 104. On the other hand, since working fluid must flow through the first layer 110 and the second layer 112, their porosities are sufficiently large not to detrimentally limit the flow of the working fluid so that performance of the regenerator is not adversely impacted.

The regenerator 100 further has an exterior wall or layer 114 that extends radially inward a relatively small amount from the exterior surface 106 toward the interior surface 108 and an interior wall or layer 116 that extends radially outward from the interior surface toward the exterior surface. In some implementations discussed below, the exterior layer 114 and the interior layer 116 are impermeable. In other implementations, the exterior layer 114 and the interior layer 116 have at least reduced porosities similar to the first end layer 110 and the second end layer 112. Consequently, with both the impermeable cases and the reduced porosity cases of the exterior layer 114 and the interior layer 116, particles are substantially prevented from exiting the regenerator 100 through the exterior surface 106 and the interior surface 108.

Figure 6:
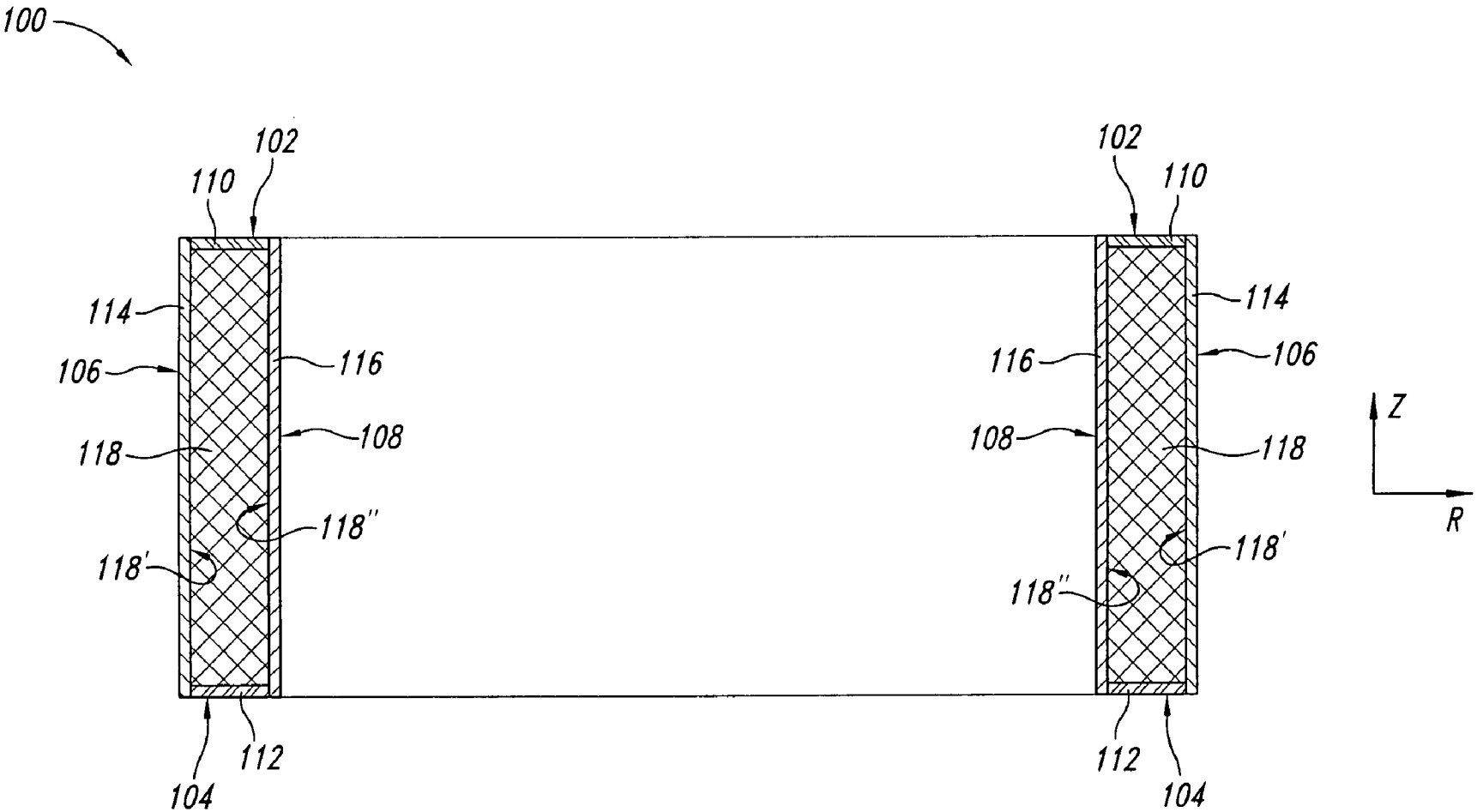
FIG. 6 is a cross-sectional schematic of the reduce shedding regenerator of FIG. 2.

Sandwiched between the first end layer 110 and the second end layer 112 in an axial or longitudinal direction, z, and between the exterior layer 114 and the interior layer 116 in a radial direction, r, is a core 118 having an exterior surface 118' and an interior surface 118", also shown in FIG. 6. The core 118 is made of continuous material having a porosity higher than the first end layer 110, the second end layer 112, the exterior layer 114 and the interior layer 116. The majority of flow of the working fluid occurs through the core 118. In order to encourage flow of the working fluid through the regenerator 100, the first end layer 110, the second end layer 112, the exterior layer 114, and the interior layer 116 are relatively thin to accommodate their lower porosities compared to the core 118 with its higher porosity.

In an exemplary implementation, the first layer 110 and the second layer 112 each originate from a sheet of loose random fiber mesh that is doubly sintered. The core 118 originates from a stack of sheets of loosely woven random fiber mesh singly sintered rather than doubly sintered to maintain a higher porosity for the core compared to the porosities of the first layer 110 and the second layer 112.

Figure 7:
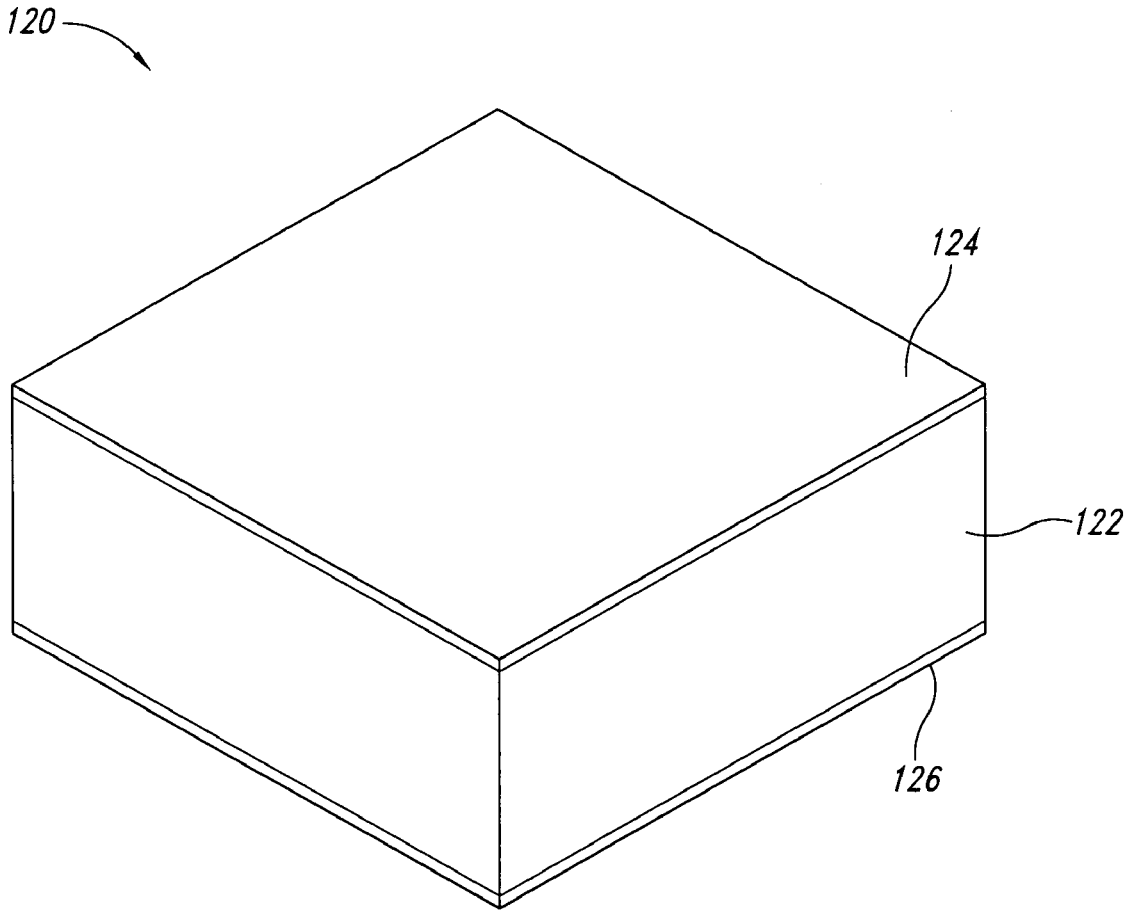
FIG. 7 is an isometric diagram of a stack of un-sintered inner sheets sandwiched between a first sintered end sheet and a second sintered end sheet.

One method of constructing the regenerator 100 will now be described in greater detail. The regenerator 100 is constructed from a stack of sheets 120, shown in FIG. 7, having a plurality of un-sintered inner sheets 122 of loosely woven random fiber mesh sandwiched between a first sintered end sheet 124 and a second sintered end sheet 126 as a combination. The first sintered end sheet 124 and the second sintered end sheet 126 are each formed from a sheet of the loosely woven random fiber mesh that has been already sintered. Both the first sintered end sheet 124 and the second sintered end sheet 126 are sintered to reduce their porosities before they are added to the un-sintered inner sheets 122 to complete the stack of sheets 120.

Figure 8:
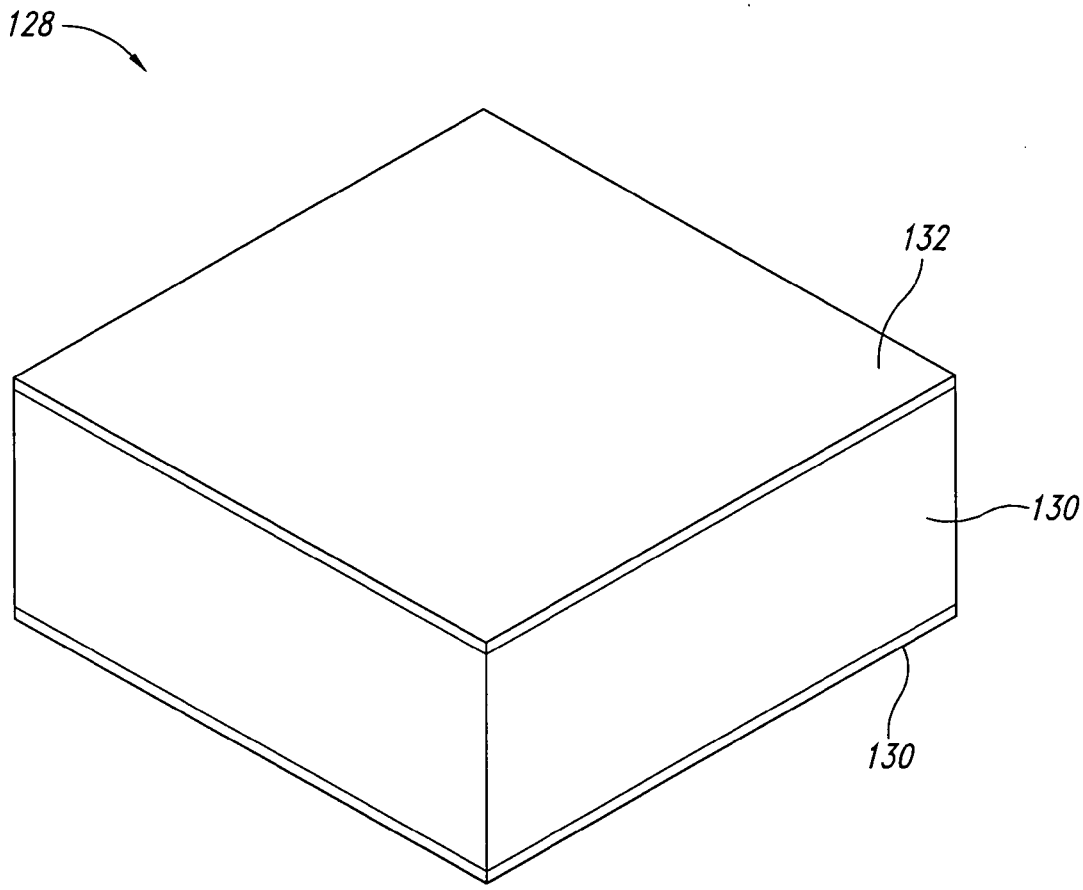
FIG. 8 is an isometric diagram of a block of continuously porous material having a core layer of once sintered material sandwiched between a first layer and a second layer of twice sintered material.

The stack of sheets 120 having the un-sintered inner sheets 122 sandwiched between the first sintered end sheet 124 and the second sintered end sheet 126 is then sintered to form a block 128 of continuously porous material having a core layer 130 of once sintered material sandwiched between a first layer 132 and a second layer 134 of twice sintered material, as shown in FIG. 8. Since the first layer 132 and the second layer 134 are sintered twice, whereas the core layer 130 is sintered once, the first and second layers of the block 128 have a lower porosity than the core layer of the block. The porosity of the first layer 132 and the second layer 134 is sufficiently low to substantially retain particles inside the core layer 130 that would otherwise tend to migrate from the core layer during assembly or operation. In contrast, the porosity of the core layer 130 provides sufficiently high porosity to allow for proper flow of the working fluid in the regenerator 100.

Figure 9:
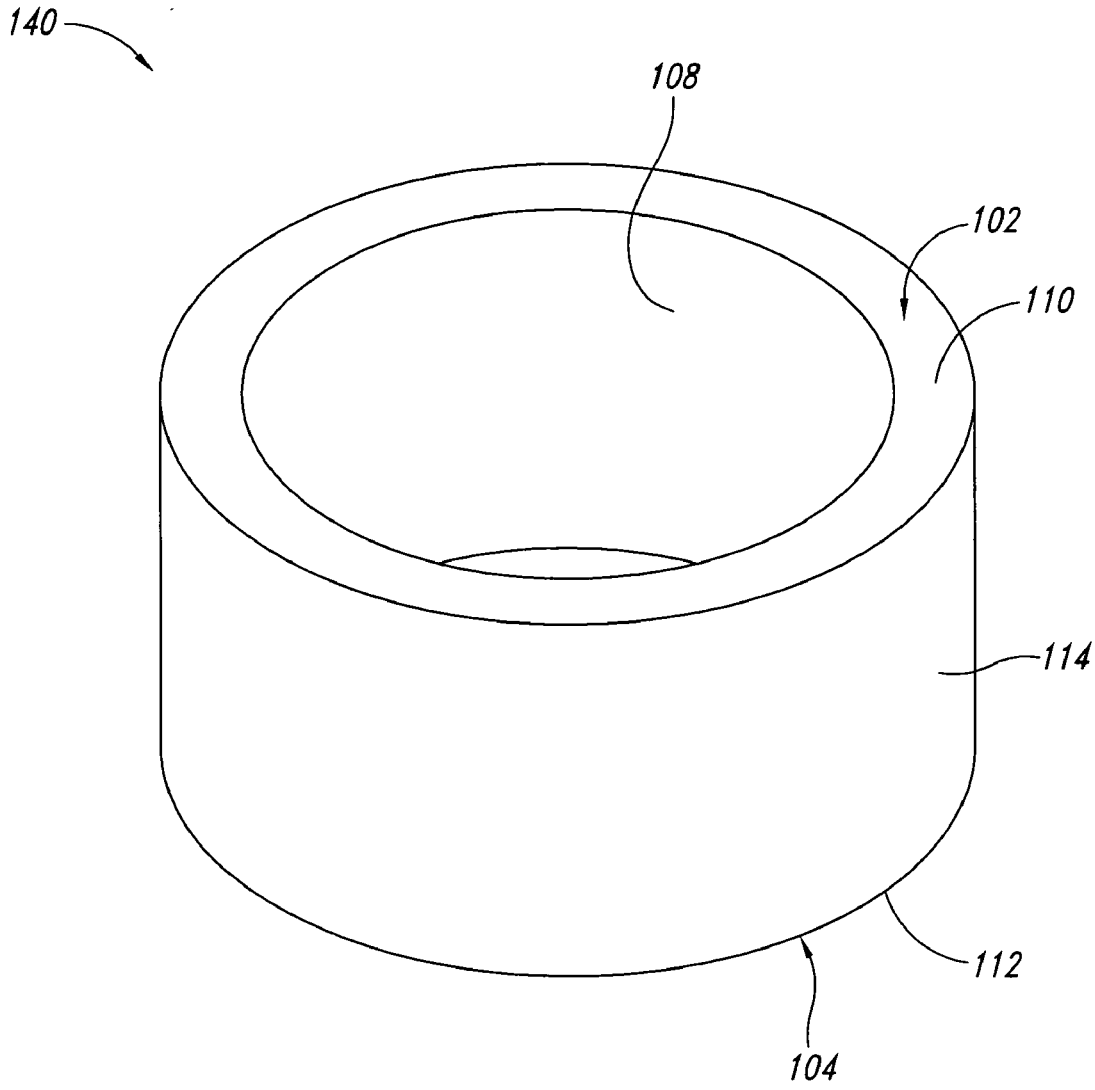
FIG. 9 is an isometric diagram of a post-machined block including the core, the first layer and the second layer.

The block 128 is then machined using conventionally known techniques to a post-machined block 140 including the core 118, the first end layer 110 and the second end layer 112, as shown in FIG. 9. In some first implementations, additional material is amended to the post-machined block 140 to provide the exterior layer 114 and the interior layer 116 of the regenerator 100. In these first implementations, the block 128 is machined to accommodate subsequent material amendment without exceeding dimensional requirements of the regenerator 100.

Examples of material amendment include, referring to FIG. 6, sealing the exterior surface 118' and the interior surface 118" of the core 118 with a braze material. Braze foil can be bonded, for instance, by spot welding, on the exterior surface 118' of the core 118 to serve as the exterior layer 114 and on the interior surface 118" of the core to serve as the interior layer 116, and then vacuum brazed to seal the exterior and interior surfaces.

Again referring to FIG. 6, another example of material amendment involves brazening a first metal ring onto the exterior surface 118' to seal the exterior surface and a second metal ring onto the interior surface 118" to seal the interior surface. The first and second metal rings are then machined to produce thin metal walls as the exterior wall 114 and the interior wall 116, respectively, sealing the exterior surface 118' of the core 118 and the interior surface 118" of the core, respectively.

In another second implementation, after the block 128 is machined into the post-machined block 140, the exterior surface 118' of the core 118 and the interior surface 118" of the core are treated to seal these surfaces to decrease their porosity and thereby reduce particle shedding. In this implementation, no additional material is amended to the post-machined block 140, so the post-machined block is near dimensional requirements of the regenerator 100 with an accounting for slight dimensional change due to surface treatment.

In yet another implementation, no additional material is added or no treatment of the post-machined block 140 is performed after the block is machined. Accordingly, in this implementation, the post-machined block 140 is machined to dimensional specifications of the regenerator 100. The machining forms the exterior wall 114 and the interior wall 116 from those portions of the core 118 near the exterior surface 118' and the interior surface 118", respectively, thereby sealing the exterior and interior surfaces of the core.

In another implementation, the block 128 is cut by laser to form the post-machined block 140, which has the dimensional requirements of the regenerator 100. The laser cutting melts the core 118 at the exterior surface 118' and the interior surface 118" to form the exterior wall 114 and the interior wall 116, respectively, thereby sealing the exterior and interior surfaces of the core. Another implementation uses a laser and cover gas to locally melt a sprayed braze alloy or a braze foil wrap to form the exterior wall 114 and the interior wall 116 or other layers or walls.

In another implementation the first layer 110 and the second layer 112 are not used, but the regenerator 100 still has the exterior wall 114, the interior wall 116, and the core 118. In another implementation the first layer 110 and the second layer 112 are used and the exterior wall 114 and the interior wall 116 are not used. Other implementations are used for other configurations of regenerators where the regenerators are solid without any annulus. The various procedures described above are used to form wall and/or layers for one or more surfaces of these types of regenerators to also reduce shedding.

Implementations described herein process end surface portions (such as for the first layer 110 and the second layer 112) of the porous material other material components need to be handled for these end surfaces. For other surfaces of the porous material can be either processed or in some implementations can be covered with other material to possibly provide additional resistance to shedding. Whether processing or additional materials are used for these other surfaces, one goal is to have relatively thin barriers.

Thin barriers on the regenerator are desirable since the barriers provide a conduction path between hot and cold temperature regions, which causes a parasitic heat loss. Stirling cycle efficiency can be better maintained if this parasitic heat loss can be minimized by keeping barriers thin. Also, thin barriers help to maintain Stirling cycle efficiencies in another way by allowing for greater volume available to the Stirling cycle rather than being taken up by thicker barriers. In contrast to these implementations, conventional approaches seek to cover only end portions with screening material.

Table 1 lists some of the methods used by implementations discussed herein to provide barriers for regenerator surfaces such as those for the external wall 114 and the interior wall 116 and other than the end surfaces such as those for the first layer 110 and for the second layer 112. Also shown are various barrier thickness ranges associated with these implementations. These methods work with regenerators made from various materials including sintered random fiber mesh, sintered woven mesh, rolled mesh and coiled sheet. Additionally, the methods work with regenerators fabricated with end caps of woven screens having a mesh of lower porosity than the regenerator. Other material also include powered metals and plastics. As shown by Table 1 all the thicknesses involved are less than 0.020 inches.

TABLE 1

| Method | Thickness range (inches) |
|---|---|
| Sleeve | .005–.015 |
| Laser | .002–.005 |
| "Slow" EDM pass | .001–.005 |
| Braze foil | .001–.002 |
| Braze paste | .002–.010 |

The sleeve method refers to brazing or sintering a solid metal sleeve to regenerator surfaces that are other than end surfaces such as described above to form the exterior wall 114 and the interior wall 116 for the annular implementation. The metal sleeve can either be attached at finish dimensions or machined later. Machining the sleeve at a later operation could result in a thinner sleeve. The metal sleeve operation ensures a solid sleeve, however, installation may be complicated, additional one or more parts may require fabrication and a final machining operation may be required after the sleeves are brazed. It is also possible that sleeves being made of other materials could be so fastened and further processed according to technologies adapted to the material such as a ceramic.

The laser method refers to regenerator surfaces other than end surfaces are melted using a laser to form a solid surface. The coverage and depth of the melted surface region can be controlled by varying the speed and power of the laser. This method can be time intensive may not result in a completely impervious wall.

The slow EDM pass method refers to using electric discharge machining (EDM) to perform a slow pass with an EDM machine to form barriers on the surfaces of the regenerator. An advantage is that the method merely requires a change to operational parameters of the machine that also manufactures the core portions of the regenerators in addition to forming the protective barriers. As with the laser, the EDM process does not guarantee a completely impervious wall.

The braze foil and paste method refers to either paste or foil being brazed on to regenerator surfaces other than end surfaces to form an impervious surface. Foil is available in a preset thickness, which can result in a uniform barrier thickness. Application of the paste can be more problematic than the foil to obtain a uniform thickness.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. For a thermal regenerative machine having a first temperature area and a second temperature area, a regenerator comprising:

a first layer portion having a first thickness, a first porosity, and a first material composition; and a second layer portion adjacent the first layer, the second layer having a second thickness, a second porosity, and the first material composition, the second thickness being greater than the first thickness, the second porosity being greater than the first porosity, the regenerator configured to be positioned within the thermal regenerative machine such that the first layer portion is nearer the first temperature area than the second layer portion, the first layer portion made from a first number of sheets of random fiber material and the second layer portion made from a second number of sheets of random fiber material, the first number being smaller than the second number, the random fiber material of the first layer portion sintered a first number of times and the random fiber material of the second layer portion sintered a second number of times, the first number being greater than the second number.

2. The regenerator of claim 1 wherein the second number is one.

3. For a thermal regenerative machine having a first temperature area and a second temperature area, a regenerator comprising:

a first layer portion having a first thickness, a first porosity, and a first material composition;

a second layer portion adjacent the first layer, the second layer having a second thickness, a second porosity, and the first material composition, the second thickness being greater than the first thickness, the second porosity being greater than the first porosity, the regenerator configured to be positioned within the thermal regenerative machine such that the first layer portion is nearer the first temperature area than the second layer portion; and a third layer portion adjacent the second layer portion on a side thereof away from the first layer portion, the third layer having the first material composition and a thickness less than the second layer portion, the third layer portion having a porosity less than the second layer portion, the regenerator configured to be positioned within the thermal regenerative machine such that the third layer portion is nearer the second temperature area than the first and second layer portions.

4. The regenerator of claim 3 wherein the first layer portions and the third layer portions are constructed from a twice sintered sheets of random fiber material and the second layer portion is constructed from a once sintered sheets of random fiber material.

5. For a thermal regenerative machine having a first temperature area and a second temperature area, a regenerator comprising:

a first layer portion having a first thickness, a first porosity, and a first material composition; and a second layer portion adjacent the first layer, the second layer having a second thickness, a second porosity, and the first material composition, the second thickness being greater than the first thickness, the second porosity being greater than the first porosity, the regenerator configured to be positioned within the thermal regenerative machine such that the first layer portion is nearer the first temperature area than the second layer portion, the second layer portion configured to shed particles sized with respect to the second porosity of the second layer portion that they pass through the second layer portion toward the first layer portion, and the first porosity of the first layer portion being sufficiently small to prevent at least a majority of the shed small particles from passing through the first layer portion.

6. For a Stirling cycle device, a regenerator comprising:

a wall having a first porosity and a thickness smaller the 0.020 inches; and a material coupled to the wall, the second material having a second porosity being greater than the first porosity, the wall comprising at least one of the following: braze foil, braze paste, and sprayed braze alloy.

7. For a Stirling cycle device, a regenerator comprising:

a wall having a first porosity and a thickness smaller the 0.020 inches; and a material coupled to the wall, the second material having a second porosity being greater than the first porosity, the wall formed from treated portions of the material with the porosity reduced thereof by the treatment.

8. For a Stirling cycle device, a regenerator comprising:

a wall having a first porosity and a thickness smaller the 0.020 inches; and a material coupled to the wall, the second material having a second porosity being greater than the first porosity, the wall comprising laser melted portions of the material.

9. For a Stirling cycle device, a regenerator comprising:

a wall having a first porosity and a thickness smaller the 0.020 inches; and a material coupled to the wall, the second material having a second porosity being greater than the first porosity, the wall being contiguous with the material.

10. For a Stirling cycle device, a regenerator comprising:

a wall having a first porosity and a thickness smaller the 0.020 inches; and a material coupled to the wall, the second material having a second porosity being greater than the first porosity, the wall comprising laser melted braze portions.

11. A method of constructing a regenerator for a Stirling cycle device, the method comprising:

sintering a first portion of fiber mesh to produce a first sintered portion;

combining the first sintered portion with a second portion of fiber mesh to produce a combined portion; and sintering the combined portion.

12. The method of claim 11 wherein the sintering the first portion includes sintering two sintered sheets of loosely woven random fiber mesh material.

13. The method of claim 12 wherein the combining includes placing a stack of un-sintered sheets of loosely woven random fiber mesh material sandwiched between the two sintered sheets to produce the combined portion.

14. The method of claim 11 comprising shaping the combined portion to a desired shape to fit within the Stirling cycle device.

15. The method of claim 14 wherein the shaping is accomplished at least in part by machining the combined portion.

16. The method of claim 15 wherein machining the combined portion includes electric discharge machining (EDM).

17. A method of constructing a regenerator for a Stirling cycle device, the method comprising:

providing a porous material having surfaces; and brazening a metal to at least a portion of at least one of the surfaces.

18. The method of claim 17 wherein the providing includes providing a porous material having portions with different porosities.

19. The method of claim 18 further including machining the metal ring to leave a thin metal layer brazen adjacent to the porous material.

20. The method of claim 17 wherein the brazening a metal includes brazening a metal ring.

21. A method of constructing a regenerator for a Stirling cycle device, the method comprising:

providing a porous material having surfaces; and vacuum brazing a foil to a portion of at least one of the surfaces.

22. The method of claim 21 wherein the vacuum brazing seals a braze foil to the portion of the surface.

23. A method of constructing a regenerator for a Stirling cycle device, the method comprising:

providing a porous material having a first porosity; and laser cutting the porous material to provide a surface with a porosity less than the first porosity.

24. A method of constructing a regenerator for a Stirling cycle device, the method comprising:

providing a porous material having surfaces and a first porosity; and sealing a portion of at least one of the surfaces to reduce the porosity of the portion of the surface.

25. The method of claim 24 wherein the providing a porous material includes providing a porous material with a first porosity and the sealing causes the porosity of the portion of the surface to be changed to a second porosity less than the first porosity.

26. The method of claim 24 wherein the sealing includes sealing the portion of the surface to be impermeable.

27. A method of constructing a regenerator for a Stirling cycle device, the method comprising:

providing a porous material having a first porosity; and heating a surface of the porous material with a laser to provide a surface with a porosity less than the first porosity.

28. For a Stirling cycle device, a regenerator comprising:

a first wall with a thickness less than 0.020 inches and having an interior surface shaped to bound an interior space having first and second open ends, the first wall having a first porosity;

a second wall with a thickness less than 0.020 inches and extending about and spaced apart from the first wall, the second wall having a second porosity;

a first material positioned between the first wall and the second wall, the first material having a third porosity greater than the first porosity and the second porosity; and a first end wall having a fourth porosity and spanning between the first and second walls at a location toward the first open end, and a second end wall having a fifth porosity and spanning between the first and second walls at a location toward the second open end, the third porosity being greater than the fourth porosity and the fifth porosity.

29. A method of constructing a regenerator for a Stirling cycle device, the method comprising:

providing a porous material having surfaces; and brazening a paste to at least a portion of at least one of the surfaces.

* * * * *